US006481356B2

(12) United States Patent
Gualandi

(10) Patent No.: US 6,481,356 B2
(45) Date of Patent: Nov. 19, 2002

(54) BULLET SETTING OUT MECHANISM FOR HUNTING CARTRIDGES

(75) Inventor: Ezio Gualandi, Bologna (IT)

(73) Assignee: Elio Gualandi & C. SRL, Idice (IT)

( * ) Notice: Subject to any disclaimer, the term of this patent is extended or adjusted under 35 U.S.C. 154(b) by 0 days.

(21) Appl. No.: 09/747,826

(22) Filed: Jun. 15, 2001

(65) Prior Publication Data

US 2001/0032564 A1 Oct. 25, 2001

(51) Int. Cl.[7] ..... F42B 12/02; F42B 14/06

(52) U.S. Cl. ..... 102/439; 102/448; 102/517; 102/522; 244/3.23

(58) Field of Search ..... 102/439, 448–453, 102/517, 520–523; 244/3.23

(56) References Cited

U.S. PATENT DOCUMENTS 4,043,267 A * 8/1977 Hayashi ..... 102/523
4,413,564 A * 11/1983 Brown ..... 102/439
5,479,861 A * 1/1996 Kinchin ..... 102/520
6,067,909 A * 5/2000 Knoster, Jr. ..... 102/522
6,105,506 A * 8/2000 Gangale ..... 102/522

* cited by examiner

*Primary Examiner*—Harold J. Tudor
(74) *Attorney, Agent, or Firm*—J. Harold Nissen; Lackenbach Seigel

(57) ABSTRACT

A cartridge including a cartridge case for hunting cartridges including a plastic sole body with a first sector forming a wad having an upper damping formed by two parallel cylindrical bodies acting with a balancing effect on a first plate with motion to be driven by a second plate distanced on an axial pin supporting a column bearing a bullet on coaxial clutches into a contact containment cylindrical seat which seat includes two half parts separated by longitudinal cuts perimetrally extending from a disk-shaped deflagration moment for centrifugal, effect the connection points break with contemporary squeezing in opening of the half parts on the inside wall of the barrel and this permits the bullet movement starting with thrust pulse centering to obviate a possible contact with the same barrel also in presence of a narrowing. After shooting of the bullet the two separated half parts follow the bullet along the barrel falling down at the exit of the barrel while the sole body goes out from the barrel.

16 Claims, 3 Drawing Sheets

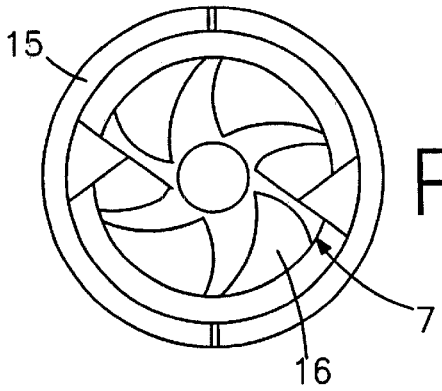
FIG. 5
FIG. 6
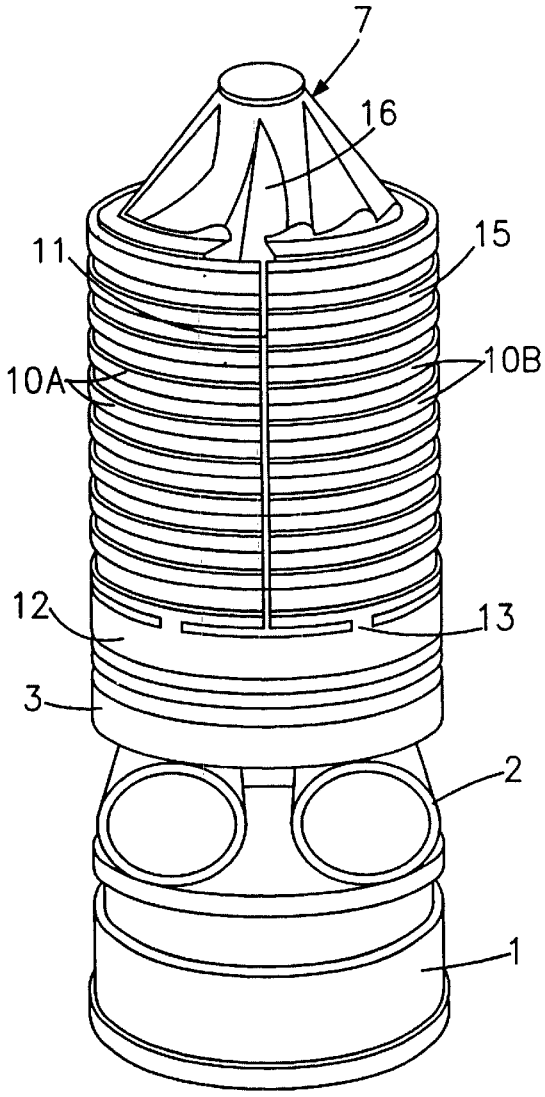
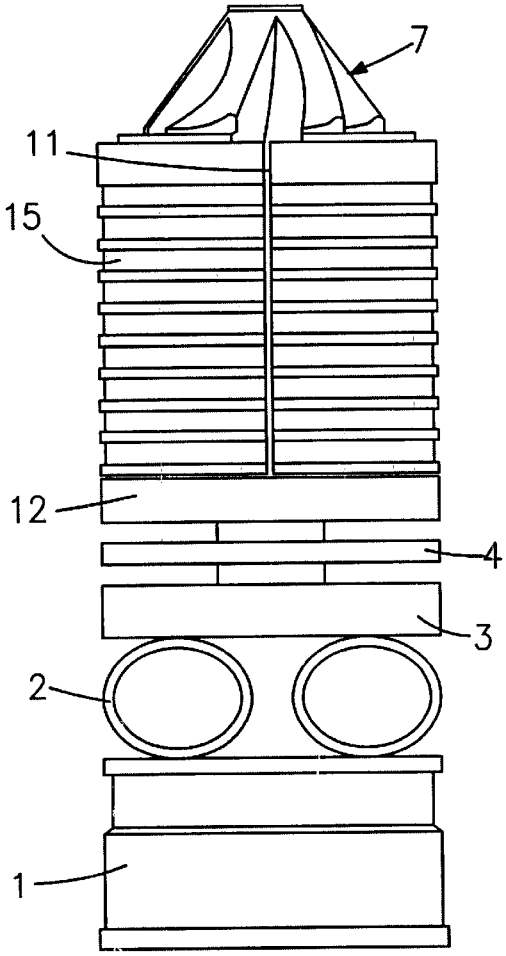
FIG. 4

BULLET SETTING OUT MECHANISM FOR HUNTING CARTRIDGES

BACKGROUND OF THE INVENTION

The invention is concerned with a cartridge and a bullet setting mechanism for hunting cartridges including a plastic sole body for thrust pulse centering.

BRIEF SUMMARY OF THE INVENTION

More particularly, the invention is concerned with a sole body axially supporting a bullet on its end by a coaxial clutch on a column that extends into a cylindrical seat for contact containment. The cylindrical seat is formed by two half-parts which are separated by longitudinal cuts, and connection points are provided for the two half parts to be perimeterally supported on a disk-shaped base by means of the connection points. During a deflagration or firing for centrifugal effect the two half parts are simultaneously separated along with openings by a breaking or separation of the connecting points to the connecting points to avoid any possible friction between the outer surface of the bullet and the inside wall of a gun or rifle barrel. Such friction is to be avoided both at the beginning of the trajectory by the two half parts acting in interposition than during the prosecution or movement of the bullet. Also in case of a narrowing of the barrel to accommodate a larger gage barrel a rifle in comparison with a bullet of narrower gage.

In the case of using a bullet having the same gage as the rifle or gun barrel, it is to be considered that the friction problem creates the presence of lead tracks on the inside of the barrel. At the starting position and as a result of narrowings frequent cleaning is required to avoid operating flaws in the case of residual accumulation. Moreover, it is necessary to consider an interference condition in a trajectory with a possibility of inexactness and power loss when firing the bullet. To obviate these problems which are current with present day rifles using components called "to wad of flinging" into a case or into a shell for bullets of lesser gage of the barrel. These methods have a problem which necessarily requires the handling and mounting of the different components such as the wad, the various bullet setting mechanisms, the bullet body and others before introducing them into the case thereby creating tremendous loading costs and a precariousness in working owing to the tolerance bounds of the single components. The present invention overcomes the aforesaid problems and provides a solution by realizing a new bullet setting mechanism which is provided with a plastic sole body mounted with only one phase and also facilitates automatic loading. This provides for a big reduction in the mounting costs and a working condition with the centering of the thrust pulse. Other features of the new mechanism is provided by the axial sequential disposition of the components acting one after another during the deflagration or firing to determine a centering condition by a raising of the thrust pulse. The axial disposition provides:

a) a potting sector of central conversion of the thrust pulse acting like a wad;

b) a damping sector which consists of two parallel cylindrical bodies acting as a balancing effect during the movement starting phase and acting as an autoregulated action during the cartridge henning phase and moreover the damping sector also results in a reduction of the water hammer;

c) a driven disk-shaped sector on a column for bullet support; and d) an ending sector acting like a cylindrical seat to contain the bullet in adherence formed by the half parts which are separated by longitudinal cuts which are actuated causing the deflagration and their contemporary breaking and opening.

To these ends, the present invention consists in the provision of a bullet setting mechanism for hunting cartridges provided with a first sector forming a wad and a pair of cylindrical bodies, a second sector including a first plate and a second plate, the first plate being in contact with the cylindrical bodies which act with a balancing effect on the first plate, an axial pin including a column provided with coaxial clutches adapted to support a bullet, the bullet having a connector for connection to the clutches, a cylindrical containment seat comprising a cylindrical member provided with a pair of longitudinal cuts for forming two half parts separated by the longitudinal cuts, the cylindrical containment seat having a disk-shaped base forming a bottom portion of the containment seat, connection, points connecting the two half parts to the base, the bullet mechanism cooperating with a cartridge case containing gun powder and a firing pin and being positionable within an inside wall of a gun barrel, and upon firing of the bullet in the gun barrel at the moment of deflagration movement for centrifugal effect, a breaking of the connection points happens with a contemporary squeezing and opening of the two half parts to extend outwardly against the inside wall of the gun barrel whereby to permit bullet movement and starting with a thrust pulse centering to obviate any possible contact with the inside wall of the barrel in the presence of a narrowing, and after the shooting or firing of the bullet, the two half parts separate and follow the bullet along the inside of the barrel and fall down after exiting from the barrel and the sole body also exits from the barrel.

Each of the half parts of the containment seat are provided on the outer surface thereof with curved reliefs which permit the separation of the two half parts from each other.

It should be noted that the bullet is provided with helical grooves which cooperate with the coaxial clutches for determining or providing gyroscopic stability to form a method for actuating a high thrust pulse centering effect to provide for a fast mounting together with automatic loading.

The helical grooves in the bullet cooperate with the column supporting the bullet by means of the coaxial clutches, which cooperate with the wad, the damping cylindrical bodies, the lower plate and the upper driven plate on the axially spaced pin. The helical grooves cooperate with the clutches in a constrained condition prior to firing and also are able to determine gyroscopic stability to provide a new system for actuating a high thrust pulse centering effect to permit a fast mounting with automatic loading.

Other features of the invented mechanism will be appreciated because of the shape of the outside wall of the bullet containment half parts formed by a parallel transversal series of curved reliefs interposed with plane parts form resistance ribs which are able to resist the deflagration crash and thereby permit their separation from the barrel.

BRIEF DESCRIPTION OF THE DRAWINGS

In order that the invention will be more clearly understood and readily carried into effect, reference is made to the following figures of drawings:

FIG. 4 is a front view of the bullet setting mechanism;

FIG. 5 is a top view of the bullet setting mechanism looking down from the top of the drawing as illustrated in FIG. 4;

FIG. 6 is another perspective view of the bullet setting mechanism with the bullet set in place in the bullet setting mechanism.

DETAILED DESCRIPTION OF THE INVENTION

Figure 1:
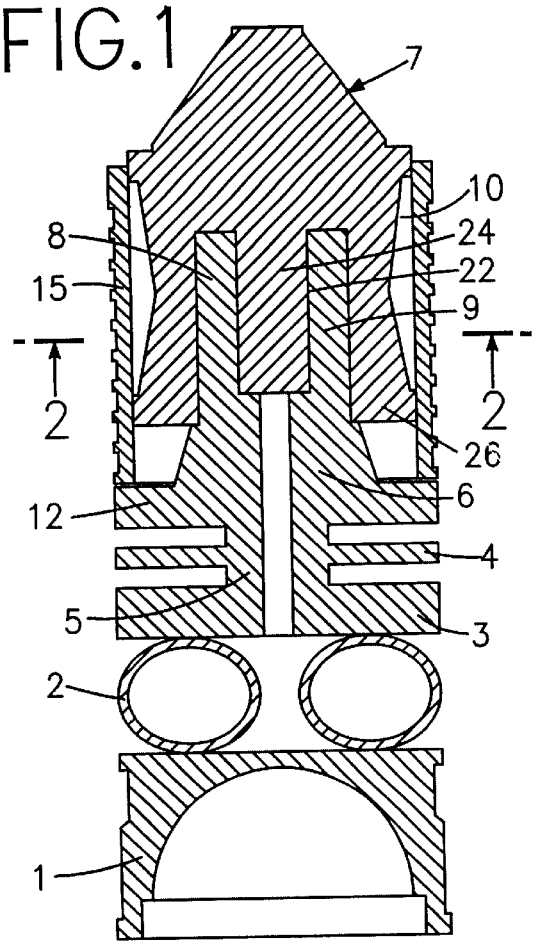
FIG. 1 is a longitudinal axial sectional view of the bullet setting mechanism taken on a longitudinal axis thereof, with a bullet inserted into the bullet setting mechanism and held in place thereto.

Referring now more particularly to the drawings which show the best mode presently preferred by me for carrying out the invention, the bullet setting mechanism comprises a plastic sole body with a first sector, forming a wad 1 and an upper damper formed by two parallel cylindrical bodies 2 acting with a balancing effect on plate 3 positioned above the cylindrical bodies with motion to be driven by an upper plate 4 positioned on an axial pin 5 which supports column 6 carrying bullet 7 on a pair of coaxial clutches 8 and 9 positioned in a contact containment seat 10. Helical grooves 16 are provided on bullet 7.

Figure 3:
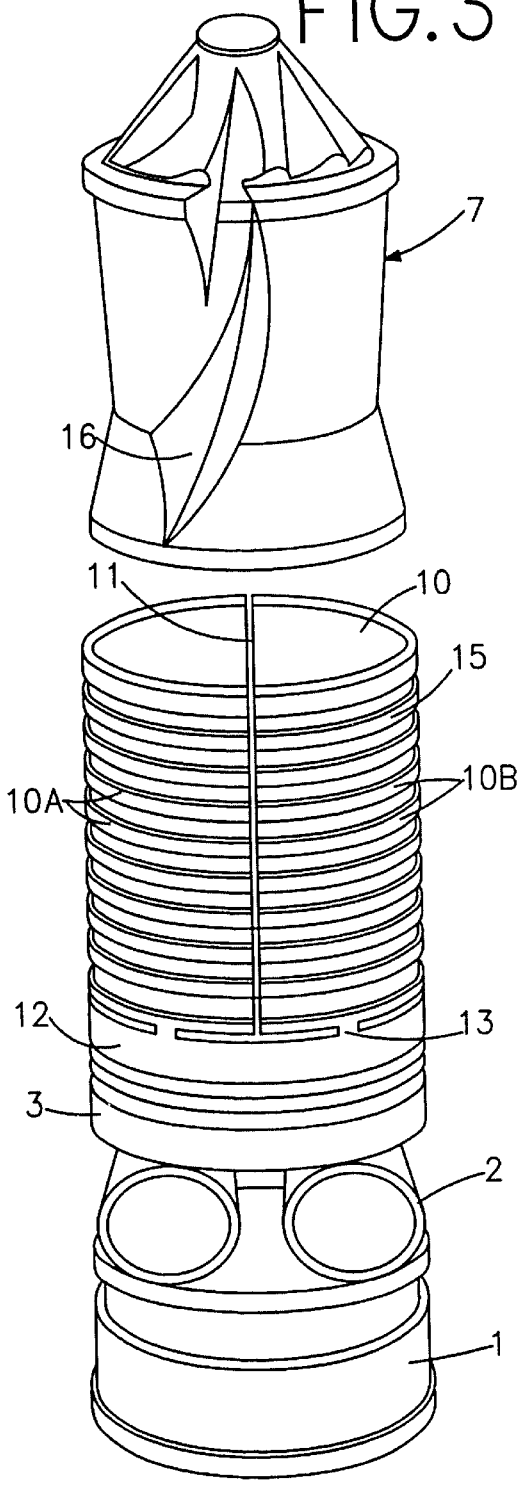
FIG. 3 is an exploded perspective view of the bullet setting mechanism.
Figure 2:
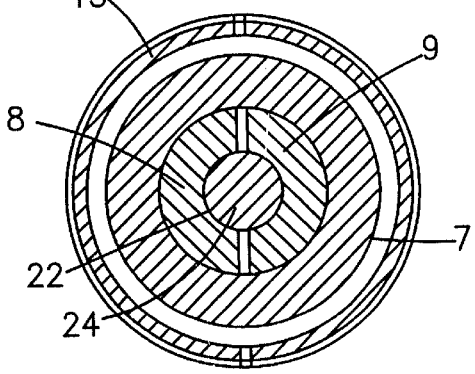
FIG. 2 is a transverse sectional view taken on an axis orthogonal to the longitudinal axis.

The seat 10 consists of two half parts 10A and 10B separated by a pair of spaced longitudinal cuts 11 perimetrally rising from disk-shaped base 12 forming the bottom of seat 10 on two or more connection points 13. During the deflagration moment for centrifugal effect, the connection points 13 break together with a contemporary squeezing and opening of the half parts 10A and 10B juxtaposed to and positioned on the inside wall of rifle barrel 14, see FIG. 8. This permits the bullet 7 to move and to start with a center thrust pulse to obviate any possible contact with the inside wall of the barrel 14 even in presence of a narrowing. After a shooting, or discharging or firing of the bullet, the two separated half parts 10A and 10B follow the bullet along the inside wall of the rifle barrel and fall down at the exit end of the barrel while the plastic sole body also exits from the barrel after the bullet. To permit resistance to a deflagration crash the half parts 10A and 10B of the containment seat 10 are provided on their outer surface with outside parallel inwardly curved reliefs 15, which permit the separation. The use in a plastic sole body of the parts sequentially acting, like the wad 1, a damping with cylindrical bodies 2 cooperating with plate 3, and the upper driven plate 4 on the axially spaced pin 5. The column 6 supports bullet 7 and is able to maintain the bullet under a constrained condition because of cooperation between the coaxial clutches 8 and 9 and the helical grooves 16 on bullet 7 which enables the bullet setting mechanism to provide a gyroscopic stability, and results in the formation of a new means and method for actuating firing and forming a high thrust pulse centering effect, and thereby permits a fast mounting also with automatic loading of the bullet. The bullet 7 exemplified is a 20 gage bullet for a barrel intended for a 12 gage barrel. As noted, FIG. 1 shows in particular a longitudinal sectional view of the setting mechanism with the bullet 7 inserted into the mechanism and supported or carried by coaxial clutches 8 and 9. FIG. 3 shows an exploded view of the mechanism with the bullet 7 separated from the bullet setting mechanism and specifically containment seat 10.

Figure 7:
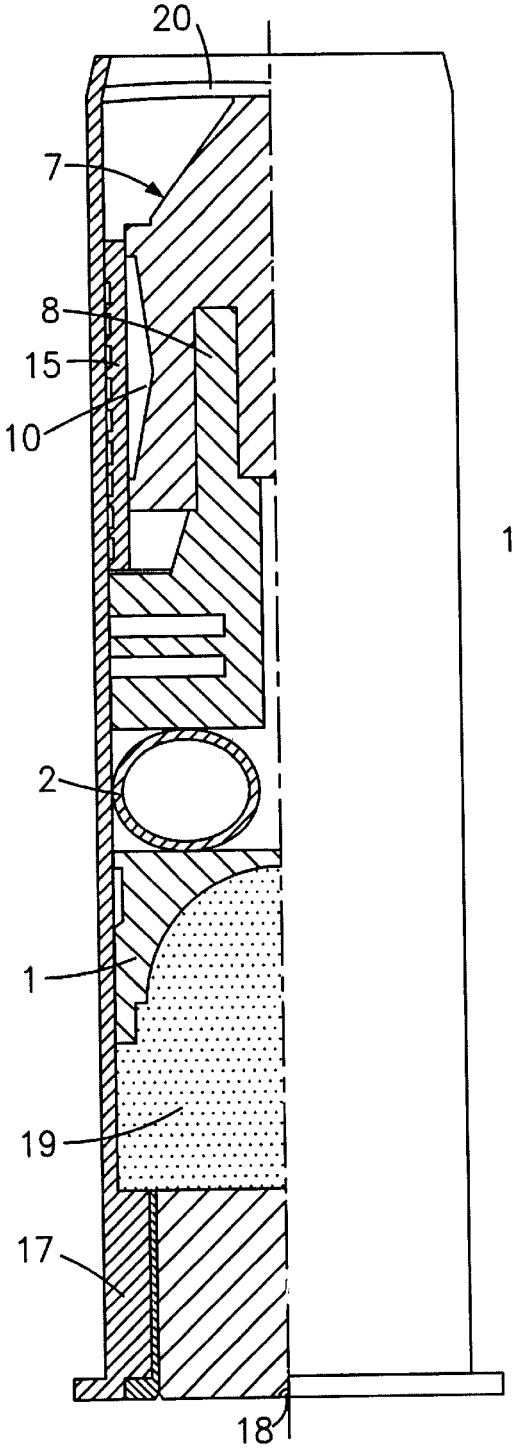
FIG. 7 is a longitudinal partial sectional view of the bullet setting mechanism, the bullet set in place in the bullet setting mechanism shown contained within an outer, cartridge case, a firing pin and an explosive material positioned adjacent to the base on bottom of the bullet setting mechanism, and an upper pad contained within the outer cartridge case at the top of the bullet above the bullet setting mechanism.
Figure 8:
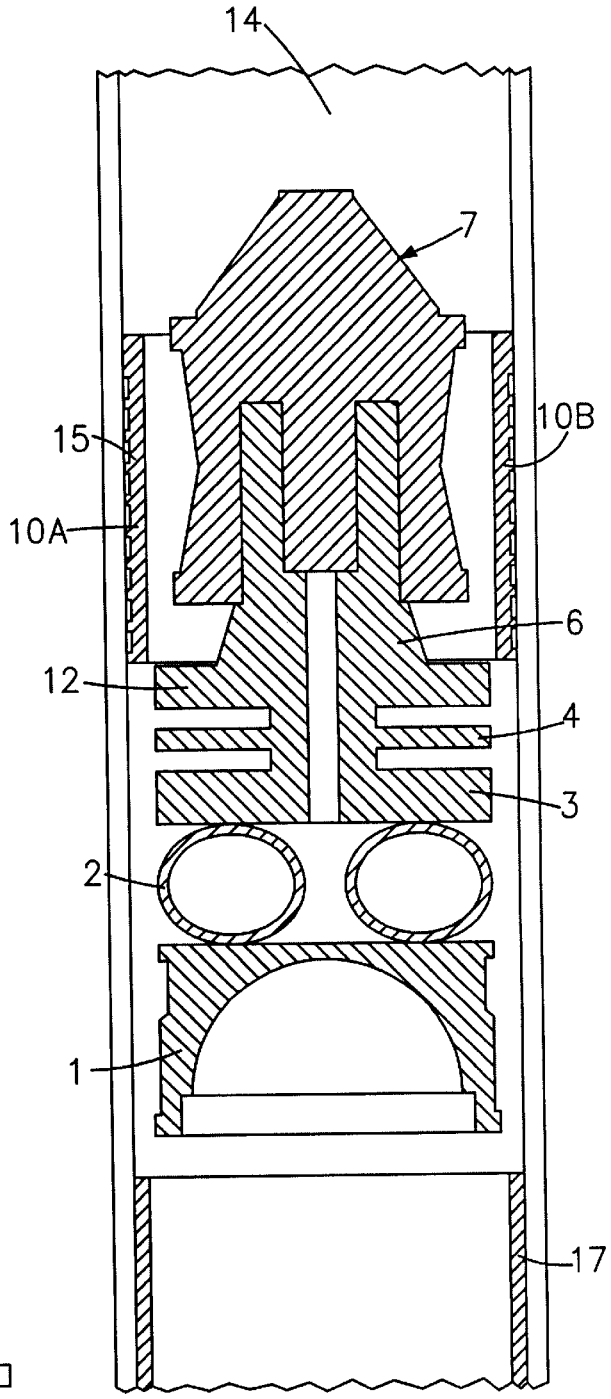
FIG. 8 is a partial sectional, partial schematic view of a firearm barrel with the bullet setting mechanism and the bullet coupled therewith positioned outside of the cartridge case, and the couple or pair of containment half parts and outward curved reliefs on the connection half parts positioned on the inside wall of the firearm barrel.

Referring now more particularly to FIGS. 7 and 8, barrel 14 is shown with cartridge case 17, firing pin 18, gun powder 19 and an upper closing point 20, all contained within barrel 14. In addition, in FIG. 7 barrel 14 is not shown, and gun powder 19 is shown juxtaposed to firing pin 18, including wad 1, cyclindrical body 2, clutches 8, 9, bullet 7, containment seat 10 and together with the mechanism contained within cartridge case 17.

FIG. 8 also shows a schematic view of a part of a barrel with cartridge case 17 and the couple or pair of containment half parts 10A and 10B inwardly curved reliefs 15 positioned on the inside wall of the barrel.

The invention generally consists in the provision of a bullet setting mechanism for hunting cartridges comprising the plastic sole body with the first sector 1, forming the wad, having an upper damper formed by two parallel cylindrical bodies 2 acting with a balancing effect on plate 3 with motion driven by plate 4 distanced on axial pin 5 and supporting column 6 which bears or supports bullet 7 on coaxial clutches 8 and 9 and is positioned into a contact containment cylindrical seat 10. The seat 10 as noted consists of two half parts 10A and 10B separated by the longitudinal cuts 11 perimetrally starting at one end from disk-shaped base 12 forming the bottom of the same seat at the connection points 13. In the deflagration or firing moment, for centrifugal effect, a breaking of the connection points 13 happens together with a contemporaneous squeezing and opening of the half parts on the inside wall of barrel 14 (see FIG. 8). This permits the bullet to move starting with a thrust pulse centering so as to obviate any possible contact with the inside wall of the barrel and also in the presence of a narrowing of the inside wall. After the shooting, the two separated half parts follow the bullet along the inside wall of the barrel falling down at the exit end of the barrel while the sole body also goes out from the barrel after the bullet.

In order to provide for resistance to the deflagration crash, the half parts of the containment seat 10 are provided with outside parallel curved reliefs 15 which permit the separation of the two half parts 10A and 10B.

It should also be noted that use in a sole body of the sequentially acting parts, like wad 1, the damping with cylindrical bodies 2 with plate 3 and the upper driven plate 4 on axially spaced pin 5, the column 6 supports bullet 7 in a constraint condition, and the coaxial clutches 8 and 9 together with helical grooves 16 on the bullet enable or provide for a gyroscopic stability and a new mechanism actuating a high thrust pulse centering effect, and it also permits a fast mounting with the automatic loading.

Clutches 8 and 9 are defined as coaxial clutches which are formed from a cylindrical member extending from column 6 above central pin 5. At the lower portion of column 6, the coaxial clutches are formed by two concentric semi-cylindrical members, and at the upper portion of column 6, the two concentric semi-cylindrical members become a single cylindrical member having a central bore 22 for receiving a center portion 24 of bullet 7. The outer portion 26 is received within contact containment cylindrical seat 10.

While there has been shown what is considered to be the preferred embodiments of the invention, various changes and modifications may be made without departing from the scope of the invention.

What is claimed is:

1. A cartridge including a cartridge case comprising:

a first sector forming a wad and a pair of cylindrical bodies;

a second sector including a first plate and a second plate, said first plate being in contact with said cylindrical bodies which act with a balancing effect on said first plate;

an axial pin supporting a column having coaxial clutches attached to a bullet having a connector for connection to said clutches;

a cylindrical seat comprising a cylindrical member provided with a pair of longitudinal cuts forming two half parts separated by said longitudinal cuts, said cylindrical member having a disk-shaped base forming a bottom portion of said cylindrical member, connection points connecting said half parts to said base;

said column having one end extending into said cylindrical seat carrying said bullet and having its other end coupled with said disk shaped base and said first and said second plates;

said first sector cooperating with a cartridge case containing gun powder and a firing pin and being positionable within an inside wall of a gun barrel, and upon firing of the bullet in the gun barrel at the moment of deflagration movement for centrifugal effect, a breaking of the connection points happens with contemporary squeezing and opening of said half parts to extend outwardly against said inside wall of said gun barrel whereby to permit movement of the bullet starting with a thrust pulse centering to obviate any possible contact with the inside wall of the barrel in the presence of a narrowing, and after the shooting the two half parts separate and follow the bullet along the inside of the barrel and fall down after exiting from the barrel.

2. The cartridge as claimed in claim 1, wherein each of said half parts are provided on the outer surface thereof with curved reliefs which permit the separation of said half parts.

3. The cartridge as claimed in claim 1, wherein the bullet is provided with helical grooves which cooperate with said coaxial clutches for determining gyroscopic stability.

4. The cartridge as claimed in claim 1, including helical grooves in the bullet for cooperating with said column supporting the bullet by means of said coaxial clutches, which cooperate with said wad, the damping cylindrical bodies, and wherein said first plate forms a lower plate, said second plate is an upper plate, said first plate and said second plate are positioned on said axially spaced pin, said helical grooves cooperating with said clutches in a constrained condition prior to firing for determining gyroscopic stability.

5. The cartridge, as claimed in claim 1, wherein said cylindrical bodies are parallel to each other.

6. The cartridge, as claimed in claim 1, wherein said longitudinal cuts extend from said base to the top of said cylindrical member.

7. The cartridge as claimed in claim 2, wherein the bullet is provided with helical grooves which cooperate with said coaxial clutches for determining gyroscopic stability to form a method for actuating a high thrust pulse centering effect to provide for a fast mounting together with automatic loading.

8. The cartridge as claimed in claim 1, including helical grooves in the bullet for cooperating with said column supporting the bullet by means of said coaxial clutches, which cooperate with said wad, the damping cylindrical bodies, the first plate and said, second driven plate on said axial spaced pin, said helical grooves cooperating with said clutches in a constrained condition prior to firing and also is able to determine gyroscopic stability.

9. The cartridge, as claimed in claim 8, wherein said cylindrical bodies are parallel to each other.

10. The cartridge, as claimed in claim 9, wherein said longitudinal cuts extend from said base to the top of said cylindrical member.

11. In connection with a rifle having a bore, a bullet cartridge comprising:

a column including a cylindrical clutch means at one end thereof attached to a bullet and a pair of spaced plates at another end thereof;

said column including a base for supporting said column;

said column being provided with a pair of longitudinal slits forming two half parts and connection points for connecting the two half parts to said base;

said base being coupled with said pair of spaced parallel plates;

a wad and a pair of cylindrical bodies supported on said wad, said cylindrical bodies supporting one of said spaced parallel plates to provide for a damping formed by said pair of cylindrical bodies;

and said two slits cooperating with said clutch means and the inner wall of said barrel and said connection points such that in the deflagration moment for centrifugal effect the breaking of the connection points happens with contemporary squeezing in opening of half parts on the inside wall of the barrel whereby to permit bullet movement starting with a thrust pulse centering thereby obviating a possible contact with the barrel in presence of a narrowing, and after shooting the half parts exit from the barrel and fall down.

12. In the device of claim 11, wherein a cartridge case is provided for containing the bullet, and including gun powder and a firing mechanism contained within said cartridge.

13. In the device of claim 11, wherein the slits are spaced diametrically opposite to each other dividing said column into said two half parts which spread outwardly after firing.

14. In the device of claim 11, wherein the breaking of the two connection points runs with contemporary squeezing in opening of said two half parts on the inside wall of the barrel.

15. In the device of claim 12, wherein the slits are spaced diametrically opposite to each other for dividing said column into said two half parts which spread outwardly after firing.

16. In the device of claim 15, wherein the breaking of the connection points together with contemporaneous squeezing opens the half parts on the inside wall of the barrel.

* * * * *